US005529012A

United States Patent [19]

Rytand

[11] Patent Number: 5,529,012

[45] Date of Patent: Jun. 25, 1996

[54] SEMI-FLEXIBLE HINGES FOR A FLOATING DOCK

[76] Inventor: David H. Rytand, P.O. Box 546, Bellevue, Wash. 98009-0546

[21] Appl. No.: 180,668

[22] Filed: Jan. 12, 1994

[51] Int. Cl.[6] ..... B63B 35/00

[52] U.S. Cl. ..... 114/263

[58] Field of Search ..... 114/258, 259, 114/263, 264, 266, 267; 16/225; 405/218–221; D12/316, 317

[56] References Cited

U.S. PATENT DOCUMENTS

| | | | |
|---|---|---|---|
| D. 270,529 | 9/1983 | Thompson . | |
| 1,900,319 | 3/1933 | Vermeulen . | |
| 2,879,735 | 3/1959 | Pointer . | |
| 3,009,326 | 11/1961 | Williams . | |
| 3,012,533 | 12/1961 | Tellefsen . | |
| 3,073,271 | 1/1963 | Brill . | |
| 3,073,274 | 1/1963 | Lamb . | |
| 3,091,203 | 5/1963 | Usab . | |
| 3,157,144 | 11/1964 | De Jarnett . | |
| 3,179,076 | 4/1965 | Sheffield . | |
| 3,276,209 | 9/1962 | Mosdell . | |
| 3,323,479 | 6/1967 | Filak . | |
| 3,448,709 | 6/1969 | Hardwick, Jr. . | |
| 3,580,202 | 5/1971 | Thompson . | |
| 3,659,540 | 5/1972 | Toby et al. . | |
| 3,789,446 | 2/1974 | Rudelick . | |
| 3,861,340 | 1/1975 | Clingenpeei . | |
| 3,951,085 | 4/1976 | Johnson et al. . | |
| 3,977,344 | 8/1976 | Holford . | |
| 4,041,716 | 8/1977 | Thompson . | |
| 4,097,958 | 7/1978 | Van Dell | 16/225 |
| 4,126,006 | 11/1978 | Lewis . | |
| 4,223,629 | 9/1980 | Dunlop . | |
| 4,231,135 | 11/1980 | Fradin | 16/225 |
| 4,252,470 | 2/1981 | Sluys . | |
| 4,260,293 | 4/1981 | Peterson . | |
| 4,316,426 | 2/1982 | Meeusen . | |
| 4,318,361 | 3/1982 | Sluys . | |
| 4,318,362 | 3/1982 | Jung . | |
| 4,353,320 | 10/1982 | Sluys . | |
| 4,354,611 | 10/1982 | Propst et al. | 16/225 |
| 4,355,431 | 10/1982 | Diefendahl et al. . | |
| 4,365,577 | 12/1982 | Heinrich . | |
| 4,365,914 | 12/1982 | Sluys . | |
| 4,418,634 | 12/1983 | Gerbus . | |
| 4,453,488 | 6/1984 | Watchorn . | |
| 4,538,939 | 9/1985 | Johnson . | |
| 4,543,903 | 10/1985 | Kramer . | |
| 4,559,891 | 12/1985 | Shorter, Jr. . | |
| 4,709,647 | 12/1987 | Rytand . | |
| 4,715,307 | 12/1987 | Thompson . | |
| 4,887,654 | 12/1989 | Rytand . | |
| 4,930,184 | 6/1990 | Kristmanson . | |
| 4,940,021 | 7/1990 | Rytand . | |
| 4,962,716 | 10/1990 | Fransen et al. . | |
| 4,968,182 | 11/1990 | Westwell . | |
| 5,044,829 | 9/1991 | Hemminger . | |

FOREIGN PATENT DOCUMENTS

| | | |
|---|---|---|
| 800802 | 12/1968 | Canada . |
| 2055703 | 8/1979 | United Kingdom . |

*Primary Examiner*—Stephen Avila

*Attorney, Agent, or Firm*—Klarquist Sparkman Campbell Leigh & Whinston

[57] ABSTRACT

A semi-flexible hinge for interconnecting a floating dock wherein the dock is comprised of a pair of floating, rectangular sections positioned end-to-end in spaced-apart relation. The adjacent ends of the floating dock sections each have a vertical, planar face, facing and parallel to the face of the adjacent dock section. The semi-flexible hinge includes a channel member mounted to each of said adjacent dock faces. Each channel member has a pair of opposing flanges extending horizontally and perpendicularly in relation to the dock face. Each channel member has a plurality of U-shaped knuckles mounted thereon. The knuckles are comprised of a length of semi-flexible material. A hinge pin passes through the aperture of the aligned knuckles attached to both channel members such that the dock sections can pivot, twist, and move vertically relative to one another. In another illustrative embodiment, the semi-flexible hinge includes top and bottom hinge straps interconnecting the floating dock sections. The hinge straps are arranged substantially parallel to one another, and are secured at each end to opposing flanges attached to each dock face.

21 Claims, 2 Drawing Sheets

SEMI-FLEXIBLE HINGES FOR A FLOATING DOCK

BACKGROUND OF THE INVENTION

1. Field of the Invention

This invention concerns semi-flexible hinges for connecting sections of floating docks. More particularly, this invention relates to dock hinges which comprise semi-flexible, energy-absorbing, wear-resistant materials, and which are specially configured in order to reduce the stress exerted upon interconnected dock sections and the hinges themselves.

2. General Discussion of the Background

Hinges or other coupling mechanisms for floating docks are normally designed of metal and typically involve metal-to-metal wearing surfaces. As such, these hinges tend to wear at a rapid rate. Indeed, it is not uncommon for some hinges constructed in this manner to have a life cycle measured in days or weeks.

Metal-to-metal type hinges also often do not allow movement in more than one plane, or substantially restrict movement of the interconnected sections of the dock. This restricted movement translates to added stress on the hinge which further contributes to its wear and deterioration. Also, hinges that significantly restrict movement of the dock in relation to wave action or other load forces can result in structural damage to the dock since added forces and energy are exerted upon the structural members of the dock rather than being dissipated through movement or absorbed by the hinge material.

Thus, there is a need for a hinge which is flexible enough to provide greater latitude in movement of the interconnected sections of the dock in order to reduce the amount of stress placed upon the dock. There is also a need for a hinge for a floating dock which is energy-absorbing, durable and wear-resistant.

It is an object of the present invention to provide a semi-flexible, energy-absorbing hinge for a floating dock which is highly resistant to wear and deterioration.

It is a further object of the present invention to provide a hinge structure for interconnecting floating dock sections that does not generate the irritating noise associated with squeaking metal-to-metal hinges.

It is a further object of the present invention to provide a hinge which is semi-flexible and which allows for substantial freedom of movement between dock sections in more than one plane, but which has sufficient stiffness to maintain the sections in a spaced relation.

It is yet another object of the present invention to provide a semi-flexible hinge which significantly reduces load forces exerted upon the structural members of the interconnected sections of the floating dock as the sections move as a result of wave action.

It is yet a further object of this invention to provide a hinge structure for a dock which will improve the life cycle of the dock itself through damping and absorbing wave energy.

It is still a further object of this invention to provide a hinge which significantly reduces the stress placed upon interconnected dock sections, and which is positioned at or near the neutral vertical axis of certain structural members of the dock to reduce stress and strain on the dock.

Other objects and advantages of the invention will become apparent hereinafter.

BRIEF DESCRIPTION OF THE INVENTION

In accordance with an illustrated embodiment, the foregoing objects are achieved by a semi-flexible hinge that includes a channel member attached to each adjacent face of interconnected sections of a floating dock, substantially U-shaped, semi-flexible knuckles attached to the channel members and aligned with one another to define an aperture therethrough, and a hinge pin inserted through the aperture of the aligned knuckles, such that the dock sections can pivot, twist, and move vertically in relation to one another. The foregoing objects are also achieved by an illustrated embodiment that includes a pair of substantially parallel and spaced-apart, semi-flexible hinge straps secured at their ends to opposing flanges attached to each adjacent face of the interconnected dock sections. Said embodiment contains no moving parts or wear surfaces.

DETAILED DESCRIPTION OF A PREFERRED EMBODIMENT

Figure 1:
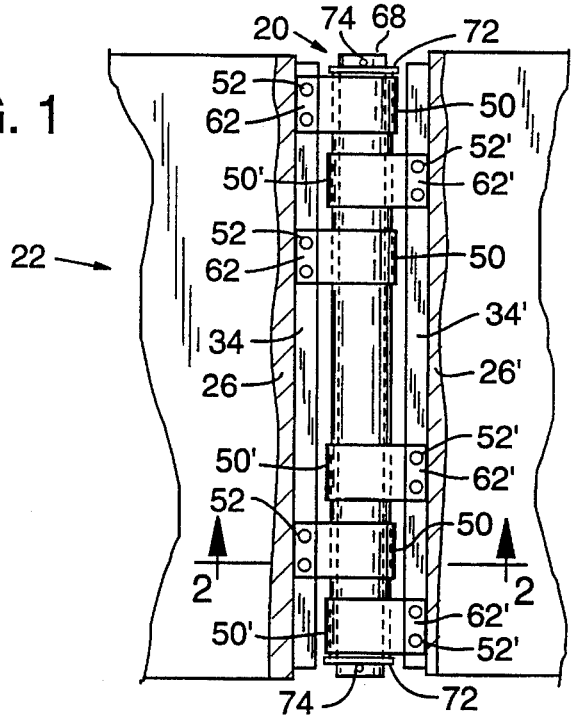
FIG. 1 is a top view, partially broken away, of dock sections interconnected with a semi-flexible hinge in accordance with the invention.
Figure 2:
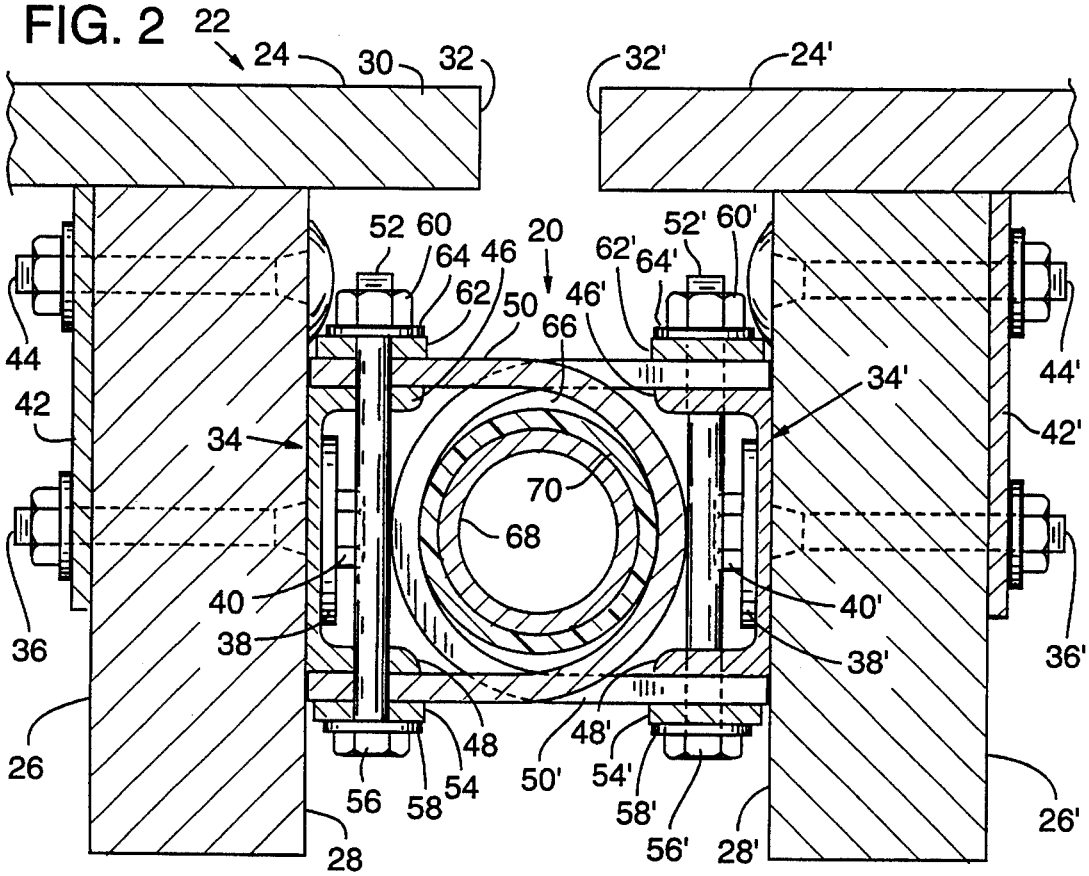
FIG. 2 is an enlarged cross-sectional view taken along line 2—2 of FIG. 1.

Referring first to FIGS. 1–2, the embodiment therein illustrated comprises a semi-flexible hinge 20 for a floating dock 22. More particularly, the semi-flexible hinge of the present invention is suitable for use with floating docks of the type shown in my prior patents, namely U.S. Pat. Nos. 4,709,647, 4,887,654, and 4,940,021, and in my pending application Ser. No. 08/106,116, filed Aug. 13, 1993. Omitted from the drawings of this application are any showing of the float modules that are present in the dock structure.

The semi-flexible hinge 20 of the present embodiment is especially suitable for use with a floating dock 22 comprising a pair of floating, typically rectangular, dock sections 24, 24' positioned end-to-end in spaced-apart relation relative to one another. The adjacent ends of the floating dock sections 24, 24' each have a transversely extending beam 26, 26', respectively. The beams 26, 26' have substantially vertical, planar faces 28, 28', respectively, which are substantially parallel to and facing one another. In a typical dock, the adjacent faces 28, 28' are spaced-apart approximately ten inches from one another. The dock sections 24, 24' have surface platforms 30, 30' thereupon. The platform edges 32, 32' are preferably spaced approximately one or two inches from one another.

As best seen in FIG. 2, corrosion-resistant or galvanized steel channel members 34, 34' are securely mounted to the adjacent dock faces 28, 28', respectively. Preferably, the channel members 34, 34' are positioned at or near the neutral vertical axis of the beams 26, 26' of the dock sections 24, 24' to minimize the stress and force exerted on the dock. As such, each channel member 34, 34' is attached at about the vertical mid-point of each face 28, 28', respectively.

As should be appreciated from the illustrated drawings, the configuration of the hinge elements attached to each of the dock sections 24, 24' are substantially identical. Accordingly, the description of the illustrated embodiment will now be with reference to the configuration of the hinge elements attached to the dock section 24, unless otherwise noted.

The channel member 34 is preferably mounted to the dock face 28 with bolts 36 or similar fastening means. A washer 38 is preferably positioned between the head 40 of each bolt 36 and the channel member 34. As further shown in FIG. 2, a metal plate 42 is mounted to the beam 26 on the surface opposite the dock face 28. The bolts 36 through the channel member 34 also extend through the plate 42 such that the channel member is securely retained to the dock section 24. Additional bolts 44 are preferably used to secure the plate 42 to the beam 26 of the dock section 24. The plates 42 further allow the hinge 20 to withstand the load forces applied, and distribute the load forces over the beam 26.

The channel member 34 includes a pair of opposing flanges, or a top 46 and bottom 48 flange, which extend substantially horizontally and perpendicularly from the dock face 28.

A plurality of U-shaped knuckles 50 are secured to the channel member 34. The knuckles 50 are each comprised of a length of semi-flexible material, and preferably a corrosion-resistant, semi-flexible, belt-like material flexible enough to sufficiently pivot and twist to reduce the overall stress on the dock sections 24, 24' and hinge 20, and having strength enough so that the knuckles will not break under anticipated loads tending to separate the sections 24, 24'. A suitable material for the knuckles 50 is one-half inch thick Plylon 330, three-ply, fabric-carcassed rubber belting material manufactured by the Goodyear Tire and Rubber Company, Akron, Ohio. This material has a belt modulus of 18000 and has sufficient flexibility to yield such that excessive stress and strain is not imposed on the attached dock sections as they move relative to one another.

The knuckles 50 are each formed from a substantially rectangular piece of the material. For example, for a dock approximately six feet in width and with the knuckle arrangement illustrated utilizing the Plylon 330 material, each piece 50 may be approximately one-half inch thick (with a three-sixteenths inch carcass gauge), six inches in width, and one foot in length. The knuckles of each set of three shown in FIG. 1 may be spaced approximately one-quarter inch from each other, while the two innermost knuckles may be spaced approximately one to two feet apart.

One end of each knuckle 50 is secured by suitable means to the upper surface of the top flange 46 of the channel member 34, while the other end of each knuckle 50 is similarly secured to the lower surface of the bottom flange 48 of the channel member 34. In the illustrated embodiment, a pair of clamping bolts 52 extends through the ends of each knuckle 50 and the top 46 and bottom 48 flanges. A flat bar 54 having holes therethrough for receiving the bolts 52 is preferably positioned between the heads 56 of the bolts 52 and the knuckle 50 material. Additionally, a lock washer 58 is preferably positioned between the head 56 of each bolt 52 and the flat bar 54. A nut 60 is placed on the end of each bolt 52.

Similarly, a flat bar 62 having holes therethrough for receiving the bolts 52 is preferably positioned between the nuts 60 and the knuckle 50, as shown in FIG. 2. A lock washer 64 is also preferably positioned between each nut 60 and the flat bar 62.

As best shown in FIG. 2, by securing the semi-flexible material to the channel member 34 in this manner, a substantially U-shaped knuckle 50 is formed. A plurality of knuckles 50, 50' is preferably formed in this manner on each dock section 24, 24' respectively. The knuckles 50, 50' are preferably interdigitated such that no two knuckles of the same channel member 34, 34' are located immediately next to one another. Once the knuckles 50, 50' are aligned and interdigitated, an aperture 66 is formed therethrough.

As shown in FIGS. 1–2, a hinge pin 68 is inserted through the aperture 66 of the interdigitated knuckles 50, 50'. The interdigitated design of the knuckles 50, 50' as shown in FIG. 1 aids in supporting the hinge pin 68 to keep it stable and essentially centered through the aperture 66. The hinge pin 68 is preferably constructed of corrosion-resistant, galvanized metal, and most preferably, is constructed of Schedule 80 galvanized steel pipe. Also, an outer sleeve 70 made from low friction material is preferably placed on the hinge pin 68 to reduce wear and stress on the hinge pin 68 and knuckles 50, 50' as they exert force upon one another due to the twisting and pivoting of the floating dock sections 24, 24'. Preferably, the hinge pin sleeve 70 is constructed from high density polyethylene, or ultra-high molecular weight polyethylene.

The overall diameter of the pin 68 and sleeve 70 should be less than the vertical spacing between the ends of the knuckle 50. This provides a space 67 (as shown in FIG. 2) between the top of the hinge pin 68 and the knuckles 50, 50', and also between the bottom of the hinge pin and the knuckles. In this way, the dock sections 24, 24' can move vertically with respect to one another to minimize stress and strain on the dock 22. Further, the sides of the hinge pin 68 are essentially adjacent the inner apexes of the knuckles 50, 50', respectively, and the outer apex of each knuckle contacts the clamping bolts 52, 52' of the channel member 34, 34' opposite to which the respective knuckle is attached. In this way, the dock sections 24, 24' are maintained in spaced-apart relation to one another and because of the engagement of the knuckles 50, 50' with the hinge pin 68 are substantially prevented from becoming horizontally separated. This particular configuration in conjunction with the use of semi-flexible knuckles 50, 50' significantly reduces load forces on the interconnected dock sections 24, 24' as a result of wave action.

A pin keeper such as a washer 72 is preferably secured to each outer end of the hinge pin 68 in order to retain the hinge pin within the knuckles 50, 50'. The outer diameter of the washer 72 is greater than the inner width or diameter of the aperture 66. Cotter pins 74 are provided to retain the washers 72 on the hinge pin.

By this configuration, it should now be appreciated that the semi-flexible hinge 20 of the present invention allows the dock sections 24, 24' to pivot, twist, and move vertically with respect to one another with a minimum amount of stress applied to the dock sections and the hinge, thereby prolonging their life cycle. Further, the hinge 20 is essentially secured to the neutral vertical axis of the beams 26, 26' of the dock sections 24, 24' to minimize the stress or force exerted upon the dock 22. The semi-flexible nature and configuration of the hinge 20 also allow the hinge and dock 22 to substantially resist wear and deterioration.

Figure 3:
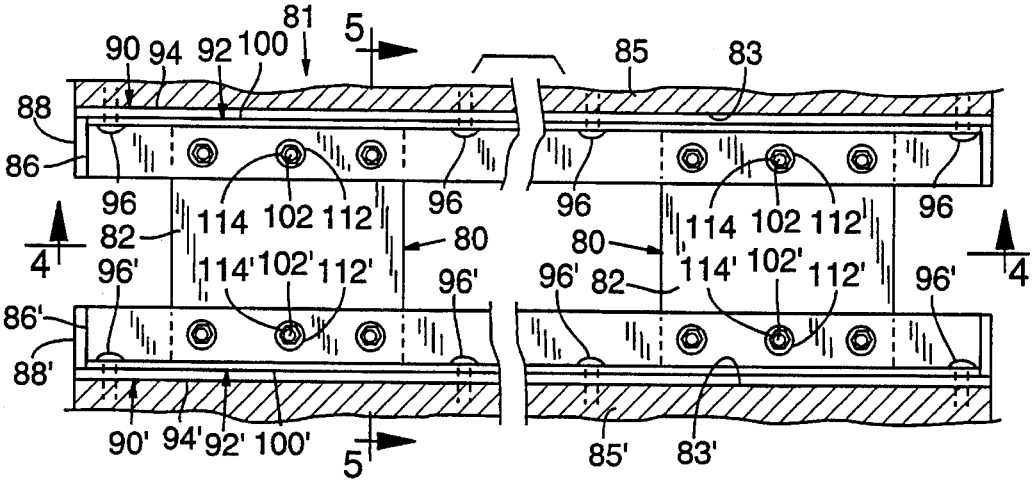
FIG. 3 is a fragmentary sectional view of a dock embodying another embodiment of a semi-flexible hinge in accordance with the present invention, taken along line 3—3 of FIG. 4.
Figure 4:
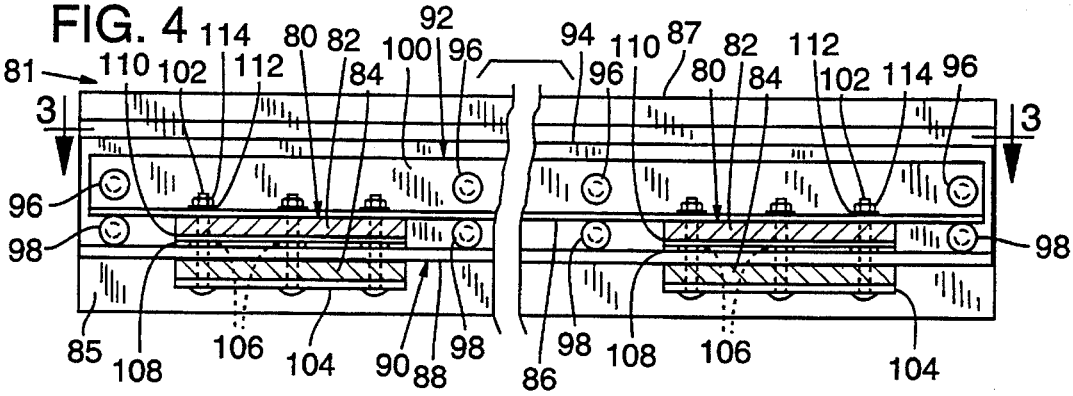
FIG. 4 is a cross-sectional view taken along line 4—4 of FIG. 3.
Figure 5:
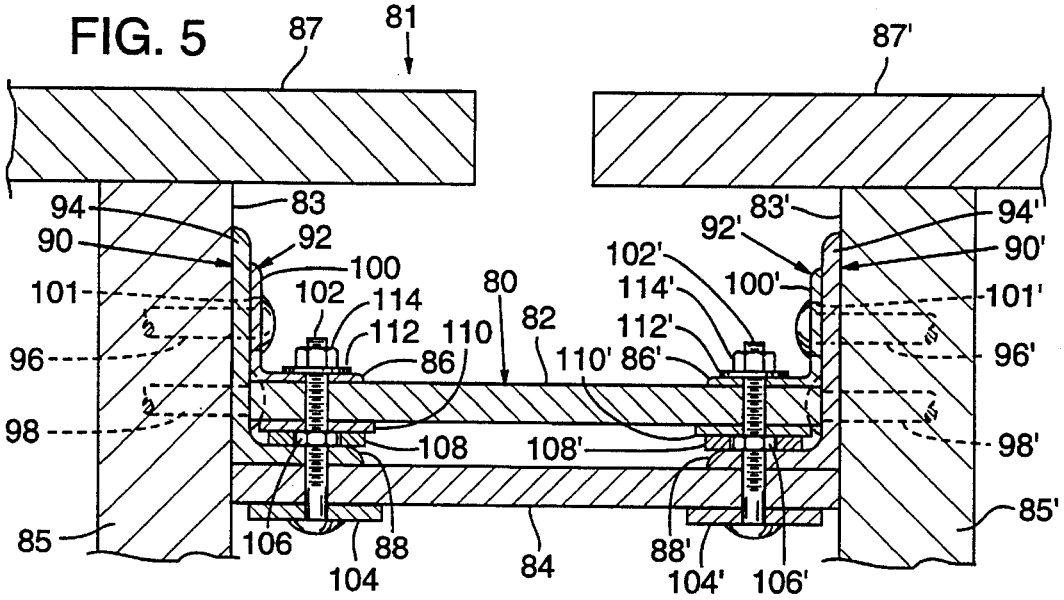
FIG. 5 is an enlarged cross-sectional view taken along line 5—5 of FIG. 3.

Referring now to FIGS. 3–5, an alternative embodiment for a semi-flexible hinge 80 for a floating dock 81 is illustrated. The semi-flexible hinge 80 of this embodiment is suitable for use with floating docks such as shown in my prior patents and application referred to previously.

As best seen in FIG. 5, the semi-flexible hinge 80 of this embodiment includes a pair of hinge straps, or top 82 and bottom 84 hinge straps, respectively, arranged substantially parallel to one another and connected at each end to an adjacent face 83, 83' of the end beams 85, 85' of the floating dock sections 87, 87'. This embodiment contains no moving parts.

The hinge straps 82, 84 are comprised of corrosion-resistant, semi-flexible material. The material must have sufficient stiffness so as not to buckle under longitudinal loads such that the dock sections 87, 87' are maintained in spaced-apart relation and will be prevented from impacting against one another. However, the strap material must also be flexible enough to allow the dock sections 87, 87' to move to a limited extent with respect to one another to absorb energy and reduce the overall stress on the dock 81. A suitable material is semi-flexible, one-inch thick (one-half inch carcass gauge), fabric-carcassed rubber conveyor belting material, such as Plylon 1200 (six-ply) belting material, with a belt modulus of 84,000, manufactured by the Goodyear Tire and Rubber Company, Akron, Ohio.

(Again, as should be appreciated from the illustrated drawings, the configuration of the hinge 80 at each dock section 87, 87' is substantially identical. Accordingly, the description of the illustrated embodiment will now be with reference to the configuration of the hinge at dock section 87, unless otherwise noted.)

Referring to FIG. 5, the hinge straps 82, 84 are attached to opposing flanges, or a top 86 and bottom 88 flange, respectively, extending horizontally and perpendicularly in relation to the face 83. The bottom flange 88 is formed on a first angle member 90, and top flange 86 is formed on a second angle member 92, respectively mounted to the dock face 83. The first angle member 90 has a vertical leg 94 positioned for mounting directly to the face 83 of the transverse beam 85 near the end of the floating dock section 87. The vertical leg 94 has a plurality of holes (not shown) therethrough for receiving suitable fastener means, for mounting the first angle member 90 to the face 83 of the beam 85, as shown. In the illustrated embodiment, as shown in FIG. 4, a top row and a bottom row of spaced-apart bolts 96, 98 secure the leg 94 to the beam 85. The flange 88 extends horizontally and perpendicularly in relation to the vertical leg 94, and hence the planar face 83 of the beam 85.

The second angle member 92 has a vertical leg 100 for mounting directly to the first angle member 90. The vertical leg 100 has a plurality of vertical slots 101 therethrough for receiving the bolts 96, which secure the second angle member 92 to the first angle member 90, and hence the face 83 of the beam 85, as shown in FIG. 5. The slots 101 coincide or are substantially aligned with the top row of holes of the first angle member 90 such that the bolts 96 can pass through both angle members. As discussed further below, the slots 101 allow the second angle member 92 to slide up or down relative to the first angle member 90.

The flange 86 extends horizontally and perpendicularly with respect to the vertical leg 100 of the angle member 92. Upon mounting the first and second angle members 90, 92 to the dock face 83 as described above, and as shown in FIGS. 4 and 5, the flanges 86, 88 of the first and second angle members are arranged substantially parallel and spaced-apart from one another.

To assemble the hinge means of this embodiment, the angle member 90 is secured to the beam 85 by the bolts 98. Next, the upper surface of the bottom hinge strap 84 (near its end) is placed adjacent to the lower surface of the bottom flange 88. Bolts 102 for securing the bottom hinge strap 84 to the bottom flange 88 are inserted upwardly through the bottom hinge strap and bottom flange, as shown in FIG. 5. A flat bar 104 having holes therethrough for receiving the bolts 102 is preferably positioned adjacent the lower surface of the bottom hinge strap 84 in order to further secure the hinge strap to the bottom flange 88.

Once the bottom hinge strap 84 has been mounted to the bottom flange 88 as discussed above, a jam nut 106 is preferably placed on each bolt 102 adjacent to the upper surface of the bottom flange 88. A flat bar 108 having holes for receiving the jam nuts 106 is also preferably placed adjacent the upper surface of the bottom flange 88, such that the jam nuts are positioned inside the respective holes of the bar 108. Next, a flat spacer bar 110 having holes therethrough for receiving the bolts 102 is preferably positioned above the bar 108.

The top hinge strap 82, previously provided with suitable bolt receiving openings, is then secured to the top flange 86 by placing an end of the strap over the bolts 102. The second angle member 92, also previously supplied with appropriate bolt holes in its flange 86, is placed in position on the bolts 102. A washer 112 is then preferably placed on each bolt 102, such that the washer rests adjacent to the upper surface of the top flange 86. A nut 114 is then placed on each bolt 102 to further secure the hinge straps 82, 84 to the flanges 86, 88.

The bolts 96 are inserted through the slots 101 in the vertical leg 100 of the second angle member 92, and the corresponding holes in the vertical leg 94 of the first angle member 90. Once the bolts 96 are placed through the slots, the second angle member is clamped against the top hinge strap 82 by tightening the nuts 114. This effects clamping of the ends of the strap members 82, 84 to the flanges 86, 88. Thereafter, the bolts 96 are rigidly secured to the beam 85, thereby also securing the adjacent ends of the straps 82, 84 to the dock section 87.

It should also be appreciated that by securing the hinge straps 82, 84 to the adjacent dock faces 83, 83', the flexible hinge 80 of this embodiment allows the dock sections 87, 87' to move with a degree of freedom with respect to one another while substantially minimizing stress to the dock 81 and hinge itself. By this configuration, the flexible hinge 80 is essentially secured at or near a neutral vertical axis of the dock sections 87, 87', such that any force or load applied to the hinge is not transferred to a point which would greatly add stress or do damage to the dock sections. As such, the hinge 80 is secured at about the vertical mid-point of each dock face 83, 83'. The semi-flexible nature of the hinge 80 also decreases its wear and deterioration rate as well as that of the dock. Accordingly, the life cycle of the dock and hinge are increased significantly.

Where moderate wave action is anticipated for a floating dock approximately ten feet in width, two hinges 80 (as shown in FIGS. 3 and 4), laterally spaced apart about five or six feet may be provided, each hinge strap 82, 84 being constructed with Plylon 1200 one-inch thick belting material, each strap being one to two feet wide and about ten inches in length, and the straps of each hinge secured near the outer ends of the dock sections 87, 87' and spaced apart vertically about one inch. Obviously, in some instances additional hinges may be provided and the strap width varied to accommodate anticipated loads from wave action. Also, by increasing the vertical spacing of the straps 82, 84, the stability between sections will be increased since, as the dock sections 87, 87' pivot relative to one another, one strap will be tensioned in bending while the other is compressed and resists bending to maintain the connected dock sections in spaced relation. Increased vertical spacing may be desired where anticipated wave action is substantial.

Having illustrated and described the principles of the invention in several preferred embodiments, it should be apparent to those skilled in the art that the invention can be modified in arrangement and detail without departing from such principles. I claim all modifications coming within the spirit and scope of the following claims.

I claim:

1. In a floating dock comprising a pair of floating, rectangular dock sections positioned end-to-end in spaced-apart relation relative to one another, the adjacent ends of said sections each having a vertical, planar face facing and parallel to the face of the adjacent section, hinge means interconnecting said floating sections, said hinge means comprising:

a pair of channel members, one of said channel members mounted horizontally on each of said dock faces, each channel member having a pair of opposing flanges extending horizontally and perpendicularly in relation to said dock face on which the channel member is mounted;

at least one knuckle means secured to each of said channel members, each of said knuckle means comprising a length of energy-absorbing, semi-flexible material mounted at its ends to the opposing flanges of said channel member such that a substantially U-shaped knuckle is defined, said knuckles aligned with one another to define an aperture therethrough; and a hinge pin inserted through the aperture of the aligned knuckle means of both channel members;

whereby said floating dock sections can pivot, twist, and move vertically relative to one another with minimum stress to said hinge means and said floating dock sections.

2. The hinge means of claim 1, wherein the hinge means includes a plurality of knuckle means on each channel member.

3. The hinge means of claim 2, wherein the knuckles are interdigitated along the hinge pin.

4. The hinge means of claim 1, wherein said hinge means further comprises means for retaining said hinge pin in place through the aperture of said aligned knuckle means.

5. The hinge means of claim 1, wherein the hinge means is positioned at or near a neutral vertical axis of the dock sections.

6. The hinge means of claim 1, wherein the hinge pin is made from galvanized steel.

7. The hinge means of claim 1, wherein a sleeve made from low-friction material is placed on the hinge pin to reduce wear and stress on the hinge means.

8. The hinge means of claim 7, wherein the sleeve is made of high-density polyethylene.

9. The hinge means of claim 7, wherein the sleeve is made of ultra-high-molecular weight polyethylene.

10. In a floating dock comprising a pair of floating, rectangular dock sections positioned end-to-end in spaced-apart relation relative to one another, the adjacent ends of said sections each having a vertical, planar face facing and substantially parallel to the face of the adjacent section, hinge means interconnecting said floating sections, said hinge means comprising:

a pair of channel members, one of said channel members mounted horizontally on each of said dock faces, each channel member having a pair of opposing flanges extending horizontally and perpendicularly in relation to said dock face on which the channel member is mounted;

a plurality of knuckle means secured to each of said channel members, each of said knuckle means comprising a length of semi-flexible material mounted at its ends to the opposing flanges of said channel member such that a substantially U-shaped knuckle is defined, said knuckles aligned with one another to define an aperture therethrough;

a hinge pin inserted through the aperture of said aligned knuckle means, said hinge pin having a sleeve made of low-friction material to reduce wear and stress on the hinge means; and means for retaining said hinge pin in place through the aperture of said aligned knuckles;

whereby said floating dock sections can pivot, twist, and move vertically relative to one another with minimum stress to said hinge means and said floating dock sections.

11. The hinge means of claim 10, wherein the hinge pin sleeve is made of high density polyethylene.

12. The hinge means of claim 10, wherein the hinge pin sleeve is made of ultra-high-molecular weight polyethylene.

13. The hinge means of claim 10, wherein the hinge means is positioned at or near a neutral vertical axis of the dock sections.

14. In a floating dock comprising a pair of floating dock sections positioned end-to-end in spaced-apart relation relative to one another, the adjacent ends of said sections each having a vertical, planar face facing and parallel to the face of the adjacent section, hinge means interconnecting said floating dock sections, said hinge means comprising:

a pair of vertically spaced-apart, semi-flexible straps extending between said faces, a pair of opposing top and bottom flanges extending horizontally and perpendicularly from each dock face for securing the ends of said straps to the adjacent dock section face;

the top hinge strap secured at one end to the top flange of one of said dock faces, and said top hinge strap secured at its other end to the top flange of the adjacent dock face;

the bottom hinge strap secured at one end to the bottom flange of one of said dock faces, said bottom hinge strap secured at its other end to the bottom flange of the adjacent dock face;

whereby said floating dock sections can pivot, twist, and move vertically relative to one another with minimum stress to said hinge means and said floating dock sections.

15. The hinge means of claim 14, wherein the top hinge strap is secured to the lower surface of each top flange, and wherein the bottom hinge strap is secured to the lower surface of each bottom flange.

16. The hinge means of claim 14, wherein each pair of opposing flanges includes:

a first angle member mounted to said dock face and having a flange extending horizontally in relation to said dock face; and a second angle member mounted to said first angle member, said second angle member having a flange extending horizontally in relation to said dock face, said flange of said second angle member positioned above and spaced-apart in substantially parallel relation to the flange of said first angle member, whereby said flange of said first angle member serves as the bottom flange and said flange of said second angle member serves as said top flange.

17. The hinge means of claim 14, wherein the hinge means is positioned at or near a neutral vertical axis of the dock sections.

18. The hinge means of claim 14, further comprising at least one bolt extending through said top and bottom hinge straps and said opposing flanges to which said hinge straps are secured.

19. In a floating dock comprising a pair of floating dock sections positioned end-to-end in spaced-apart relation relative to one another, the adjacent ends of said sections each having a vertical, planar face facing and parallel to the face of the adjacent section, hinge means interconnecting said floating dock sections, said hinge means comprising:

a pair of vertically spaced-apart, top and bottom semi-flexible straps extending between said faces;

a pair of opposing top and bottom flanges extending horizontally and perpendicularly from each dock face;

the top hinge strap secured at one end to the top flange of one of said dock faces, and said top hinge strap secured at its other end to the top flange of the adjacent dock face;

the bottom hinge strap secured at one end to the bottom flange of one of said dock faces, and said bottom hinge strap secured at its other end to the bottom flange of the adjacent dock face;

at least one bolt extending through said top and bottom hinge straps and said opposing flanges to which said hinge straps are secured;

each bolt further includes a jam nut positioned between said top hinge strap and said bottom flange, said jam nut being positioned within a hole of a jam nut flat bar also positioned between said top hinge strap and said bottom flange;

whereby said floating dock sections can pivot, twist, and move vertically relative to one another with minimum stress to said hinge means and said floating dock sections.

20. The hinge means of claim 19, further including a flat bar positioned between the head of each said bolt and said bottom hinge strap, said flat bar having holes for receiving the bolts extending therethrough.

21. The hinge means of claim 20, further including a flat spacer bar positioned between said top hinge strap and said jam nut-flat bar, and having holes for receiving the bolts extending therethrough.

* * * * *